US010519597B2

(12) United States Patent
Demuner et al.

(10) Patent No.: US 10,519,597 B2
(45) Date of Patent: Dec. 31, 2019

(54) PROCESS FOR PRODUCING DIFFERENTIATED CELLULOSE FIBERS COMPRISING AN ENZYMATIC TREATMENT IN ASSOCIATION WITH AN ACID STEP

(75) Inventors: Braz Jose Demuner, Aracruz ES (BR); Otavio Mambrim Filho, Aracruz ES (BR)

(73) Assignee: Suzano S.A., Sao Paulo (BR)

( * ) Notice: Subject to any disclaimer, the term of this patent is extended or adjusted under 35 U.S.C. 154(b) by 0 days.

(21) Appl. No.: 13/502,311

(22) PCT Filed: Oct. 16, 2009

(86) PCT No.: PCT/BR2009/000322

§ 371 (c)(1),
(2), (4) Date: Aug. 28, 2012

(87) PCT Pub. No.: WO2011/044646

PCT Pub. Date: Apr. 21, 2011

(65) Prior Publication Data

US 2012/0322997 A1 Dec. 20, 2012

(51) Int. Cl.

| | |
|---|---|
| ***D21C 9/00*** | (2006.01) |
| ***D06M 16/00*** | (2006.01) |
| ***D21C 5/00*** | (2006.01) |
| *D06M 101/06* | (2006.01) |
| *D21H 11/20* | (2006.01) |

(52) U.S. Cl.

CPC ..... *D21C 9/001* (2013.01); *D06M 16/003* (2013.01); *D21C 5/005* (2013.01); *D21C 9/002* (2013.01); *D06M 2101/06* (2013.01); *D21C 9/004* (2013.01); *D21C 9/005* (2013.01); *D21H 11/20* (2013.01)

(58) Field of Classification Search

CPC ..... D06M 16/003; D21H 11/20; D21C 9/001; D21C 5/005

USPC ..... 435/41

See application file for complete search history.

(56) References Cited

U.S. PATENT DOCUMENTS

| | | | | |
|---|---|---|---|---|
| 5,582,681 | A * | 12/1996 | Back et al. | 162/5 |
| 5,620,565 | A * | 4/1997 | Lazorisak | D21C 5/005 162/111 |
| 6,149,769 | A | 11/2000 | Mohammadi et al. | |
| 6,254,722 | B1 | 7/2001 | Jackson et al. | |
| 6,776,876 | B1 * | 8/2004 | Vuorinen | D21C 9/001 162/65 |
| 7,144,716 | B2 | 12/2006 | Saville et al. | |
| 2005/0000666 | A1 * | 1/2005 | Taylor et al. | 162/24 |
| 2006/0180285 | A1 | 8/2006 | Yang et al. | |

FOREIGN PATENT DOCUMENTS

| | | | |
|---|---|---|---|
| AT | 398 589 | B | 12/1994 |
| BR | PI 0517695 | A | 10/2008 |
| EP | 0 430 915 | A1 | 6/1991 |
| FR | 2 557 894 | A1 | 7/1985 |
| JP | 2001/303469 | A | 10/2001 |
| JP | 2004/060117 | A | 2/2004 |
| WO | WO 97/29237 | A1 | 8/1997 |
| WO | WO 98/44189 | A1 | 10/1998 |
| WO | WO 00/68500 | A1 | 11/2000 |
| WO | WO 01/32715 | A1 | 5/2001 |
| WO | WO 03/021033 | A1 | 3/2003 |
| WO | WO 2004/081185 | A2 | 9/2004 |
| WO | WO 2004/101889 | A2 | 11/2004 |
| WO | WO 2005/060332 | A2 | 7/2005 |
| WO | WO 2006/049542 | A1 | 5/2006 |
| WO | WO 2007/039867 | A1 | 4/2007 |

OTHER PUBLICATIONS

JP2004060117, English machine translation, Provided by Patent Translate, 5 pages.*

<https://www.thefreedictionary.com/saponification> Accessed Oct. 22, 2018.*

International Search Report from International Patent Application No. PCT/BR2009/000322, dated Mar. 5, 2010.

Written Opinion from International Patent Application No. PCT/BR2009/000322, dated Dec. 16, 2011.

International Preliminary Report on Patentability from International Patent Application No. PCT/BR2009/000322, dated Feb. 7, 2012.

Heidorne, Fernando O., Magalhaes, Perola O., Ferraz, Andre L., Milagres, Adriane M.F.; "Characterization of Hemicellulases and Cellulases Produced by Ceriporiopsis Subvermispora Grown on Wood Under Biopulping Conditions"; Enzyme and Microbial Technology 38 (2006) 436-442.

Office Action for European Application No. 09 740 626.8 dated May 10, 2013.

Office Action for European Application No. 09 740 626.8 dated Apr. 16, 2014.

Office Action for European Application No. 09 740 626.8 dated Apr. 17, 2015.

* cited by examiner

*Primary Examiner* — Thomas J. Visone

(74) *Attorney, Agent, or Firm* — Alston & Bird LLP

(57) ABSTRACT

The present invention refers to a process for producing cellulose of market eucalyptus fibers having distinct features through the use of at least one enzymatic treatment with hydrolytic enzymes, such as for example, xylanases, cellulases or mixtures thereof, in association to at least one acidic treatment step. These treatments may be applied into different steps of the fibers process producing, wherein all of them happen before drying.

5 Claims, No Drawings

PROCESS FOR PRODUCING DIFFERENTIATED CELLULOSE FIBERS COMPRISING AN ENZYMATIC TREATMENT IN ASSOCIATION WITH AN ACID STEP

FIELD OF THE INVENTION

The present invention refers to a process for producing cellulose fibers having improved flexibility and strength features.

BACKGROUND OF THE INVENTION

The modification of cellulose fibers features has been studied in recent years, since said features directly impact the manufacturing and the final paper characteristics. Among cellulose fibers features, the flexibility and the carboxylic groups number thereof are of great importance to the development of paper having improved mechanic and structural strength.

Enzymatic treatments have been used in processes for manufacturing cellulose fibers, although in most cases they are used aiming only to reduce chemical reagents consumption and to improve the aspects of the effluent generated during the cellulose fiber producing process.

On the other hand, some prior art documents disclose the differences between cellulose fibers and paper features through the application of enzymes only in the manufacturing process of paper.

Document WO03/021033 discloses an enzymatic treatment of cellulose fibers to increase the number of aldehyde groups. These groups become binding sites to hydroxyl groups of the fibers, when they are transformed into a dry sheet of paper, thus increasing the mechanical strength thereof. One of the processes disclosed in said document consists in treating the fibers with one or more hydrolytic enzymes, optionally, in the presence of surfactants, other non-cellulose enzymes or non-hydrolytic chemical reagents wherein the aldehyde groups are formed in or close to the fibers surface. The description shows that the enzymatic treatment is carried out in the approximating circuits of the paper making machine, in such a way that it is also disclosed a process for handling the aqueous suspension containing the aldehyde groups-rich fraction, carrying out the refining and/or additional mixture of further chemical additives, which are common in the paper manufacturing. After the formation of a sheet of paper, white water containing hydrolytic enzymes is collected and recycled in order to increase treatment efficacy.

Document WO00/68500 discloses a process for the production of paper with higher wet strength by treating the fibers with a phenol oxidative enzyme prior to the paper machine circuit, more specifically, in the depuration system. After the enzymatic treatment, the fibers are refined and then mixed with additives which are generally used/required for paper manufacturing.

Document WO2007/039867 discloses differentially densified fibrous structures, processes for making the same, and processes for treating fibers used in the fibrous structures. Fibers treatment was carried out using only cellulases enzymes and no acid step was associated with it. Besides, the purpose was to change paper sheet fibrous structure.

Document PI9505211-9 discloses an acid treatment focused on the hexenuronic acid removal and not in the distinction among the features of fibers. Therefore, the association of the acid step with xylanases enzymes developed according to said state of art document aimed to increase the removal of hexenuronic acids.

Document JP2001303469 discloses processes for bleaching cellulose using an acid-treating step and treatments with xylanases for reducing the amount of used bleaching chemicals required during fibers bleaching step and also to allow obtaining and separating xylooligosaccharide compounds from the generated filtrate.

Document JP2004060117 discloses a process for bleaching pulp, wherein an enzymatic treatment is used after pulp bleaching step using chlorine dioxide.

Document WO9844189 discloses processes for treating cellulose fibers in order to remove color (chromophores groups) by the application of cellulase, with pH 3.0 to 7.0, and xylanase, with pH 5.5 to 9.0. The aim of applying cellulase is to open the cell wall pores in the fibers to increase the ability of xylanase to remove the chromophores. Another treatment for preparing the fibers (increasing the swelling, and therefore enlarging the pores) is carried out using low molecular weight amine (e.g. methylamine). The enzymatic treatment is not found in association with an acid step and it also does not present any results of flexibility modification and carboxylic groups of the fibers, related to the alteration of the strength and drainage/drying.

Document U.S. Pat. No. 7,144,716 discloses a process for immobilizing enzymes through the application thereof in a pH ranging from 5.0 to 6.9. The obtained results describe only the maintenance or decrease in the enzyme activity either as a function of immobilization or not, when subjected to different shear stresses (stirring).

Document PI0517695 discloses a process for modifying fibers aiming to increase the wet strength of the paper sheet. The modification is carried out through the use of cellulose derivatives (e.g. CMC=carboxymethyl cellulose) not using enzymes. Although it uses the association of the CMC-based treatment with an acid step, it is not related to the use of enzymes.

Mora et al (1986) describes the enzymatic action for treatments performed with retention times of 24 and 88 hours in medium containing $HgCl_2$ (extremely harmful to the environment and to human health) in order to inhibit the action of cellulases, enabling the evaluation of the individual effect of the xylanases. The used temperature equals to 40° C. and the pH was not specified. The association of the enzymatic treatment with an acid step aiming to distinct the fibers was never mentioned.

Noe et al (1986) describes the enzymatic action for treatments performed with retention times of 2 to 54 hours, in a medium containing $HgCl_2$, in a temperature of 40° C. It comprises a acid washing step to denature the enzyme in order not to promote changed in the fibers. This document teaches that although the enzymatic treatment leads to improvements in the refine process, and consequently in fibers properties (e.g. flexibility), it shows that in non-refined pulps the enzymatic action itself is not sufficient to provoke changes in the cell wall of fibers, which are required for increasing of the swelling thereof, and consequently, for increasing fibers flexibility. Nevertheless, this document does not contain any description or even a suggestion on which additional treatments could be associated with the enzymatic treatment so as to obtain the desired fiber properties.

Bajpai et al (2006) describes the action of combinations of Laccase-mediator enzymes, Laccase-mediator with xylanases and Laccase-mediator with xylanase and an acid step aiming to improve the ECF bleaching, but it does not describe the effect on pulp quality, nor the possibility of using these combinations for the distinction among fibers properties. In view of that, there is a need for developing processes which result in a significant distinction in cellulose fibers features. Among said processes, those using an enzymatic treatment show a high potential in fulfilling this need.

Therefore, it is the object of the present invention to fulfill said need existing in the state of art of obtaining cellulose fibers.

SUMMARY OF THE INVENTION

The present invention refers to a process for producing cellulose fibers having distinct features comprising the association of at least one enzymatic treatment with at least one acid step.

Furthermore, the present invention also refers to cellulose fibers produced by such process.

DETAILED DESCRIPTION OF THE INVENTION

The present invention refers to a process for manufacturing cellulose fibers having distinct features. More specifically, it discloses processes comprising at least one enzymatic treatment in association with at least one acid step in order to obtain cellulose fibers having distinct features and properties, such as: flexibility, amount of carboxylic groups, tensile strength and drainage. These treatments may comprise an intermediate washing step between the above mentioned treatments, or not.

Among the properties of cellulose fibers, the amount of carboxylic groups present and fibers flexibility are basic properties for the development of improved features for further use in paper manufacturing.

The fibers having more flexibility and higher carboxylic groups number have the tendency to impart mechanical strength (tensile) higher than the paper sheets obtained from the same, with no enzymatic and/or acid treatment.

The increase in the strength occurs because the fibers presenting such features allow an increase in the contact surface area between them, leading to an increase in the number and strength of the fiber-to-fiber bonding, also because of the increase in the number of binding groups (carboxylic) in the surface of the fibers, thus allowing higher number of hydrogen bonds to be formed.

The hydrogen bonds formed when the fibers are contacted with water are present in fibers moieties containing hydroxyl groups. After water removal in the processes of de-watering and drying, said moieties for hydrogen bond become binding moieties, thus increasing the mechanical strength of the formed structure.

It was verified that at least one enzymatic treatment in association with at least one acid step promotes a distinction among cellulose fibers features, mainly its flexibility and its carboxylic groups number, leading to a significant change in the mechanical strength features, such as tensile strength and drainage of the fibrous suspension.

Such changes allow the use of cellulose fibers for different applications, and also allow an increase in paper making performance, since an increase in the yield and a decrease in process costs of are expected because said fibers changes enable better drainage/drying.

Therefore, such differences in cellulose fibers properties and features should allow applications of new uses in paper making. As an example, more flexible fibers and/or those with higher numbers of carboxylic groups may present advantages in reducing costs, mainly those related to energy supply for refining and raw materials in the paper making process (e.g. addition of strength agents and softwood fibers, which are generally more expensive than the hardwood ones). As a disadvantage, one can cite the increase in the drying energy in cases where the balance between refining and addition of strength agents is not properly set.

On the other hand, less flexible fibers and/or those with lower numbers of carboxylic groups may possess an advantage in terms of drainage and drying and an increase in paper throughput. As disadvantages, one can cite the need for increasing refining and addition of strength agents during paper making.

These examples show the great potential and importance of the distinction among cellulose fibers when providing the clients with options for the development of more suitable and balanced applications for their needs. Thus, products having features of softness, bulk, liquid absorption, porosity and better performance in the process are expected with fibers having less flexibility and lower carboxylic groups number. On the other hand, stronger and/or cheaper papers are expected when using more flexible fibers and/or those having higher carboxylic groups number.

In one preferred embodiment of the present invention, the enzymatic treatment is performed by hydrolytic enzymes action, for example, cellulases, xylanases, or a mixture thereof, in amounts ranging from 0.10 to 2.0 kilograms of enzyme per ton of cellulose. The hydrolytic enzymes used are commercial enzymes and some suppliers of them are: Novozymes, Verenium, logen, AB Enzymes and others.

Said enzymatic treatment is performed in towers usually used in cellulose storage processes or in reactors specifically designed to contain chemical reactions, such the acid step reactions.

The required temperature for process development is set to reduce the addition of fresh water, warm water and/or hot water through the best achievable balance between the recirculation of filtrates. Similarly, the pH setting may be carried out through determination of the best balance with the recirculation of acidic and/or alkaline filtrates of the bleaching sequence, in order to minimize the use of chemical reagents, acids or bases. Therefore, such parameters are not intended to limit the invention and can be set according to the specific conditions desired for each specific process.

Preferably, the enzymatic treatment is performed in towers and the reactors have a retention time ranging from 40 to 240 minutes, pH ranging from 5.5 to 8.5, the temperature ranging from 40 to 90° C., preferably, 50 to 90° C. when the hydrolytic enzyme is xylanase, 40 to 80° C. when the hydrolytic enzyme is cellulase and 40 to 80° C. when the enzymatic reagent is a mixture of xylanases and cellulases.

The enzymatic treatment stage is associated with an acid step which is performed, preferably, at the conditions usually described for processes for producing cellulose fibers with lower amount of hexenuronic acids, wherein the conditions are as follows: retention time ranging from 20 to 200 minutes, temperature ranging from 80 to 95° C. and pH value ranging from 3.0 to 4.5, using sulfuric or hydrochloric acid to for pH adjustment.

In the process of the present invention, the enzymatic treatment may be applied before, after or during cellulose fibers bleaching sequence. When performed before the bleaching stage, the enzymatic treatment retention time is from 40 to 240 minutes, when performed during the bleaching the retention time is from 40 to 90 minutes and when performed after the bleaching sequence, the retention time is from 40 to 240 minutes. When the enzyme is applied before the bleaching the acid step is applied sequentially in a stage which takes place before and/or after the enzymatic treatment.

In another embodiment of the present invention, cellulose fibers enzymatic treatments are applied after an acid step throughout cellulose fibers bleaching sequence. In such a case, the acid step is not necessary carried out sequentially to the enzymatic treatments.

In this embodiment, the enzymatic treatment may replace the first alkaline extraction, which, in general, is enhanced by oxygen and hydrogen peroxide, an oxidative treatment taking place before it, or not. If this is the case, the oxidative treatment, which is generally the first bleaching step, consists of using chlorine dioxide, ozone, hydrogen peroxide or any other chemical agent common in this kind of applications.

Examples of preferable bleaching sequences, in which the process of the present invention may be applied are: A Do EOP D1 EP D2; A Do PO D1 D2; A Do PO PP; A Do PO D P; and A D1 EP D2, wherein:

"A" refers to an acid step;

"Do" refers to a deoxidizing step;

"EOP" refers to an alkaline extraction enhanced by hydrogen peroxide and oxygen, wherein a first step of the reaction is pressurized and a second step is carried out at atmospheric temperature;

"PO" refers to an alkaline extraction enhanced by oxygen and hydrogen peroxide, in pressurized conditions;

"D1 and D2" refers to bleaching stages with chlorine dioxide;

"EP" refers to an alkaline extraction enhanced by hydrogen peroxide; and

"P" refers to a bleaching stage with hydrogen peroxide.

The process of the present invention may also comprise a washing step between the enzymatic treatment and the acid step.

The fibers used in the process of the present invention may be the so-called eucalyptus fibers.

Still another embodiment of the invention consists in enzymatic treatments performed in more than one step, in sequences containing an acid step. The use of an initial enzymatic treatment before or after the acid step, may be followed by a second and even a third enzymatic treatment in the beginning, middle or ending of the bleaching sequence.

For instance, an enzymatic stage may be used before the acid step. A second enzymatic stage may be used in place of the first alkaline extraction and still a third enzymatic stage may be applied after bleaching. This operational approach aims to increase distinction potential among fibers properties. All instances are perfectly amenable of industrial applicability.

As an example, in a cellulose production facility with bleaching sequence having the configuration of storage tower A Do EOP D E D storage tower and drying, the following combinations are possible, according to this invention: enzymatic treatment A enzymatic treatment D EP (or PO) D storage tower and drying; enzymatic treatment A enzymatic treatment D EP (or PO) D enzymatic treatment and drying. Furthermore, these configurations may also be performed when after the step A or step Do is used.

In said alternatives, the enzymatic treatments are performed using the same process conditions, previously described, and taking into account the particularities of each application point.

EXAMPLES

The present invention will be illustrated by some examples of treatments and results; nevertheless, these examples are illustrative only, and shall not be intended to limit present invention scope in any way.

It is important to note that for carrying out the examples in laboratory scale, one additional step was required, i.e. the enzymatic inactivation in order to prevent the continuation of the actions after the ending of the enzymatic stage. However, in a continuous industrial process this step is not necessary, since it naturally happens through washings, pH and temperature changes, as well as the use of oxidant agents.

The hydrolytic enzymes charge used in the examples was obtained by weighting the amount of enzyme as formulated and shipped by the respective suppliers thereof. All enzymatic treatments and acid steps were performed in a laboratory reactor (e.g. Quantum Technology—Mark or CRS model), under which the temperature, intensity and periodicity of the dynamic mixture is controlled, which are basic conditions for a good performance of the enzymatic treatment. All experimental treatments were compared to a standard condition (blank test), having the same retention time, pH, temperature, intensity and periodicity of mixture, but without enzyme presence. Each experiment was carried out using 300 grams (dry weight basis) of cellulose. The tests were conducted at 11% consistency.

Fibers flexibility measurements (F), carboxylic groups number (C), strength/tensile index (T) and drainage (D) were obtained according to the ISO or Tappi standards. For the physical tests, the samples were stored at a temperature of 23±1° C. and a relative moisture of 50±2%, for at least 4 hours.

The measurement of the tensile strength (R), that is the basis for the estimation of the Tensile Index (T) was obtained from the maximum tensile strength of a paper test sample, as gram-force/inch (gf/in). The tensile index is the rate between the tensile strength and the grammage of the sample (grammage expressed as g/3000 square feet). The tensile strength is obtained in a universal test equipment, Instron type. The maximum tensile strength is measured using a 10 N charge cell, for a tensile strength of up to 1000 gram-force and of 100 N, for higher tensile strength. The tensile strength corresponds to an average of at least eight measurements. The tensile strength is corrected so as to be set for a usual grammage variation from 15.9 to 17.1. The corrected tensile strength is obtained multiplying the measured tensile strength by 10.5 and dividing it by the grammage minus six.

Drainage was quantified through the pulp filtration resistance (PFR), using the following procedure (as described by Mohammadi et al (1998)—see U.S. Pat. No. 6,149,769): take a sample of 2543 mL of a fiber suspension, having 0.1% consistency, prepared in a 19 liters tank, through a registry coupled to the bottom of a proportionate tank, returning it to the tank through the top portion. Repeat the procedure (note that the PFR must be carried out after taking 2543 mL for checking the consistency since the height of the water column inside the proportionate tank changes the measure value). Measure the suspension temperature. Record the value in Celsius degrees. Install the connection for PFR measuring in the inferior registry of the proportionate tank of sample; Put the 100 mL glass flask below the connection (note that since it refers to a dynamic measurement having a specific recipient to this end, there is no need to calibrate it). With a single and fast movement, open the valve for sample collection and at the same time activate the chronometer in order to measure the time, in seconds, required for filling the 100 mL flask up to its mark. Record the time "A", in seconds. Discard the filtrate and without washing the screen of the connection, measure the time needed for filling the flask again. Record the time "B" in seconds. Repeat the previous item, recording the time "C" in seconds. Remove the connection and wash it in counter flow so as to remove all the pulp retained, checking that the connection sieve is clean and free of fibers which may dry and change further tests. Calculate the PFR value as follows:

$$PFR=\sqrt{E\times(B+C-2A)/1,5}$$

wherein:
A, B and C=time measurements in seconds.
E=1+0.013(T−75)
T=temperature in Fahrenheit degrees.
A short formula may be used:

$$PFR=K\times\sqrt{B+C-2A}$$

wherein:

$$K=\sqrt{E/1,5}$$

Then:

$$K=\sqrt{[1+0,013(T-75)]}$$

"K" values to temperatures ranging from 70° F. (21° C.) and 77° F. (25° C.).

| ° C. | ° F. | "K" factor |
|---|---|---|
| 21.0 | 69.8 | 0.7884 |
| 21.5 | 70.7 | 0.7933 |
| 22.0 | 71.6 | 0.7982 |
| 22.5 | 72.5 | 0.8031 |
| 23.0 | 73.4 | 0.8080 |
| 23.5 | 74.3 | 0.8128 |
| 24.0 | 75.2 | 0.8176 |
| 24.5 | 76.1 | 0.8223 |
| 25.0 | 77.0 | 0.8270 |

All the accessories/equipments were supplied by Special Machinery Corporation, 546 East Avenue, Cincinnati, Ohio 45232. The PFR measure corresponds to the Canadian Standard Freeness (CSF), obtained according to SCAN C 24-65 standard. The relationship between them is given by the following equation: PFR=78918*(CSF)−1,688.

Fibers flexibility measurements were performed according to the concept described by Steadman and Luner (1985). There is a need of a previous preparation of special microscope slides with metallic microfilament upon which the fibers to be analyzed are placed, and suitable equipment.

The methods for preparing of the microscope slide uses 5 grams of cellulose (dry weight basis) in 2000 mL of deionized water. Such fibrous suspension is then stirred in a standard laboratorial disintegrator, and then a new suspension at 0.01% consistency is prepared. For such, 8 mL of the above mentioned suspension are transferred to a 200 mL measuring cylinder, which is then completely filled with deionized water. The special slides with metallic microfilament are used to hold the fibers on a sample maker apparatus. Vacuum conditions and compressed air pressure are 7±1 mmHg e 60 psi, respectively. For each slide, 5 mL of the suspension at 0.01% consistency were used and, at the correct timing, the slide was suitably placed to receive the fibers. After pressing and drying, the slide is removed and fiber flexibility is read. In this invention a "CYBERFLEX" equipment was used. At least two slides should be prepared and the read-out should be performed on at least 300 fibers, therefore an average measuring value is obtained. It is important to note that the measurement is originally carried out on wet fibers and therefore the result is expressed as wet fiber flexibility in %.

The carboxylic groups number determination was carried out according to Tappi T237 cm-98, in which the results are expressed as milliequivalents per 100 grams of fibers (dry weight basis).

Example 1

Individual Treatments

Example 1.1

Enzymatic Treatment with Xylanases and Cellulases in Association to an Acid Step Before Bleaching The first enzymatic treatment stage was carried out using a xylanase charge of 0.5 kilogram of xylanase/ton of cellulose, pH of about 7, temperature of 75° C., in a 3 hour treatment, using a suspension at 11% consistency. The second enzymatic treatment was performed using a cellulase charge of 1 kilogram of cellulase/ton of cellulose, pH of about 7. The acid step was performed at 90° C., pH of about 3 to 4.5 using sulfuric or hydrochloric acid to set the pH, for 3 hours and 11% consistency.

After the enzymatic treatment, a method to denature the enzyme was conducted, which consisted in washing the treated cellulose with enzymes, dewatering until a consistency of 25 to 30% by weight is achieved, heating of the medium to 85 to 95° C. for 10 to 15 minutes.

The results are presented in Table 1. The results for the control condition were considered to be 100%. The treatments results are presented as percentage related to original control condition value. The results show that the individual applications of the acid step, xylanase and cellulase have different results according to the desired fibers properties, in other words, they indicate fibers properties distinctiveness.

TABLE 1

Individualized treatments results for xylanase, cellulase and acid step compared to the control condition (same application conditions, but without the acid or enzymes added).

| Fibers features | Control | Acid step | Xylanase stage | Cellulase stage |
|---|---|---|---|---|
| Flexibility | 100% | 95% | 92% | 106% |
| Carboxylic groups number | 100% | 83% | 73% | 95% |
| Tensile index | 100% | 76% | 72% | 237% |
| Pulp Flow Resistance | 100% | 99% | 91% | 162% |

The differences observed among the three types of treatment (acid step only, cellulase enzymes only or xylanase enzymes only) compared to the results of the control sample show that the three types of treatment present fibers distinction potential. The acid step, however, presented the lower effect on drainage, besides the 24% drop in tensile value (caused by the 5% reduction in fiber flexibility and the 17% reduction in the number of carboxylic acids).

In comparison to the control treatment, the step using only xylanase presented significant potential for fibers features differentiation, mainly in fibers drainage improved, which is extremely required to render paper fibers manufacturing process more economically attractive (potential for reducing the drying energy and/or increasing the throughput).

On the other hand, the treatment using only cellulase presented the highest potential for altering cellulose fibers features, mainly for raising the tensile index. An increase of up to 137% in this feature indicates a significant potential for reducing costs in paper making (energy, additives, etc), as well as for producing paper with distinct structures. It is also noted that the high possibility for obtaining the best balance between tensile and drainage (opposite of the pulp flow resistance), in specific applications, depending on the possibilities/limitations of paper manufactures (e.g. limitations with energy, production, costs and needs in the distinction of paper structures/properties).

From the results shown in Table 1, it is noted that the requirement to take into account the distinction results of the fibers obtained by the acid step, since this is already an industrial applicability in modern facilities to reduce hexenuronic groups (decrease in bleaching costs). Enzymatic treatments, when compared to the acid step, showed significant fibers features distinction (Table 2). It is noted that the xylanase stage distinguished the drainage in up to 8%, with a minimum drop in tensile. On the other hand, the cellulase stage distinguished the tensile in up to 210%. Although there was (in this case) higher difficulty in drainage, it can be observed that the high space to optimize the increase in tensile (desirable for several paper makers, and generally obtainable with huge energy and/or strength additives consumption), related to the optimum drainage.

TABLE 2

Results for individual treatments: Xylanase or cellulase compared to the acid step.

| Fibers features | Acid step | Xylanase stage | Cellulase stage |
|---|---|---|---|
| Flexibility | 100% | 97% | 111% |
| Carboxylic groups number | 100% | 88% | 115% |
| Tensile index | 100% | 94% | 310% |
| Pulp Flow Resistance | 100% | 92% | 164% |

From this point, combinations between enzymatic treatments and the acid step were effected to compare the based on the results obtained with the acidic treatment only.

Example 2

Enzymatic Treatment Associated with an Acid Step

Example 2.1

Enzymatic Treatment with Xylanase in Association with an Acid Step Before Bleaching In the combinations with the acid step, a xylanase charge of 0.5 kilogram xylanase/ton cellulose was used for the enzymatic treatment, at pH of about 7, temperature of 75° C., in a 3 hour treatment and at 11% consistency. The acid step was carried out at 90° C., at pH from 3 to 4.5, for 3 hours, at 11% consistency. After the enzymatic treatment, a enzyme denaturation treatment was performed consisting in washing the enzyme-treated cellulose, dewatering for up to 25 to 30% consistency, heating the medium at temperature of 85 to 95° C., for 10 to 15 minutes.

The xylanase stage, before or after the acidic treatment, had different results on fibers properties. However, both treatments presented a decrease in the number of carboxylic acids, tensile and pulp flow resistance. For instance, the maximum distinction of drainage (improvement of this feature in 12%, which is significant in a practical point of view) was obtained by applying the xylanase stage before the acidic treatment. It is important to note that this situation is perfectly liable to industrial applicability. On the other hand, a better combination among drainage and tensile was observed in the enzymatic treatment following the acid step (which is also possible to be used industrially).

Example 2.2

Enzymatic Treatment with Cellulase Sequential and in Association with an Acid Step Before Bleaching A cellulase charge of 1 kilogram cellulase/ton cellulose, pH of about 7, temperature of 50° C., in a 3 hour treatment, at 11% consistency was used for the enzymatic treatment. The acid step was carried out at 90° C., pH of about 3 to 4.5, for 3 hours, at 11% consistency. After the enzymatic treatment, a enzyme denaturation treatment was performed consisting in washing the enzyme-treated cellulose, dewatering for up to 25 to 30% consistency, heating the medium at temperature of 85 to 95° C., for 10 to 15 minutes.

Once again it is emphasized that the results were compared based on the data obtained with the acid step. The treatment with cellulase, before or after the acid step, presented high fibers features distinction. By way of example, it was observed that the extremes of distinction were increases of up to 24% in the flexibility and 215% in tensile, both obtained during the application of the cellulase stage before the acid step, which is industrially possible. It is noted that the temperature of the cellulase stage is not impeditive, since the thermal balance can be obtained by using a heat exchanger. However, we have evaluated that the most practical and economical approach is the balance between the charge of the enzyme versus the temperature, mainly for reactors that contain reactions for up to 3 or more hours.

Example 2.3

Enzymatic Treatment with Mixtures of Enzymes Sequential and in Association with an Acid Step Before Bleaching For the enzymatic treatment the following charges were used: 0.5 kilogram xylanase/ton cellulose with 1 kilogram of cellulase/ton cellulose, applied at pH of about 7, temperature of 55° C., for 3 hours, at 11% consistency. The acid step was carried out at 90° C., pH of about 3 to 4.5, for 3 hours, at 11% consistency. After the enzymatic treatment, a enzyme denaturation treatment was performed consisting in washing the enzyme-treated cellulose, dewatering for up to 25 to 30% consistency, heating the medium at temperature of 85 to 95° C., for 10 to 15 minutes.

It was observed that the step of mixing enzymes, associated with the acid step, also presented significant fibers distinction. The extreme distinction (increase of 29%) of the flexibility and tensile (increase of 220%) of fibers was obtained by applying cellulase before the acid step. Although a increase in cellulose pulp flow resistance was observed, it is important to consider that the balance between the tensile and drainage must be pursued on a case-by-case basis, depending on the needs for each paper application.

Example 2.4

Sequential Enzymatic Treatments with Xylanase and Cellulase in Association with an Acid Step Before Bleaching For the enzymatic treatment the following charges were used: 0.5 kilogram xylanase/ton cellulose, at pH of about 7, temperature of 75° C., in a 3 hour treatment, at 11% consistency; and 1 kilogram cellulase/ton cellulose, at pH of about 7, temperature of 50° C., for 3 hours, at 11% consistency.

The acid step was carried out at 80° C., at pH from 3 to 4.5, for 20 minutes, at 11% consistency. After the enzymatic treatment, a enzyme denaturation treatment was performed consisting in washing the enzyme-treated cellulose, dewatering for up to 25 to 30% consistency, heating the medium at temperature of 85 to 95° C., for 10 to 15 minutes.

A significant features differentiation was observed with these application alternatives (sequential enzymatic stages associated with an acid step). As an illustrative example, an increase of 273% in tensile was observed when the cellulase was applied before the xylanase stage (the acid step was applied after the enzymatic stages, taking advantage of the reactor conditions existent on an industrial scale: a storage tower, a reactor used for the acid step for applying the second enzymatic treatment and a reactor for the oxidative treatment for performing the acid step). On the other hand, the highest carboxylic groups number distinction and the best balance between tensile and drainage was obtained with the application of the xylanase stage before the cellulase stage.

Example 2.5

Sequential Enzymatic Treatments with Xylanase at Different Temperatures in Association with an Acid Step Before Bleaching A charge of 0.5 kilogram xylanase/ton cellulose, at pH of about 7, for 3 hours, at 11% consistency, at temperatures of 60° C., 75° C. and 90° C. was used for the enzymatic treatment. The acid step was carried out at 90° C., at pH from 3 to 4.5, for 3 hours, at 11% consistency. After the enzymatic treatment, a enzyme denaturation treatment was performed consisting in washing the enzyme-treated cellulose, dewatering for up to 25 to 30% consistency, heating the medium at temperature of 85 to 95° C., for 10 to 15 minutes.

The association of the acid step with xylanase enzymatic stage at different temperatures is an important cellulose fibers features differentiation mechanism. As an example, the use of a temperature of 90° C. in xylanase treatment allowed the highest level of distinction of all the properties analyzed for the xylanase treatments. Decreases of up to 11% in fiber flexibility and 31% in carboxylic groups number, had a positive impact on drainage (decrease of the pulp flow resistance) of up to 17%. As a consequence, a decrease in tensile of up to 44% was observed.

Summary of the treatments applied before bleaching—associations of the enzymatic treatment with the acid step.

Fibers features differentiation was significant, as described in Table 3.

TABLE 3

Summary of the observed extremes results of the enzymatic treatment associated with an acid step, when applied before bleaching.

| Fibers features | Increase of up to | Decrease of up to |
|---|---|---|
| Flexibility | 29% | 31% |
| Carboxylic groups number | 15% | 44% |
| Tensile index | 237% | 44% |
| Pulp Flow Resistance | 109% | 17% |

Example 3

Enzymatic Treatment Applied During the Bleaching Sequence Having an Acid Step

The following are examples of enzymatic treatments applied during bleaching, in place of oxidative alkaline extraction, in bleaching sequences having an acid step.

Example 3.1

Application Of Cellulose, Xylanase or Mixtures Thereof in Place of the Oxidative Alkaline Extraction During Bleaching Process Having an Acid Step The acid step was carried out at 90° C., at pH from 3 to 4.5, for 3 hours, at 11% consistency. The xylanase treatment was carried out using a charge of 0.5 kilogram xylanase/ton cellulose, at pH of about 7, temperature of 75° C., for 1 hour, at 11% consistency. The cellulase treatment was carried out using a charge of 1 kilogram cellulose/ton cellulose, at pH of about 7, temperature of 50° C., for 3 hours, at 11% consistency. The xylanase and cellulase mixture treatment were carried out using a charge of 0.5 kilogram xylanase/ton cellulose and 1 kilogram cellulase/ton cellulose, at 55° C., for 1 hour, at 11% consistency. After the enzymatic treatment, a enzyme denaturation treatment was performed consisting in washing the enzyme-treated cellulose, dewatering for up to 25 to 30% consistency, heating the medium at temperature of 85 to 95° C., for 10 to 15 minutes. The washing was carried out using dilution factor of 2.5, neutralization using acid or soda, depending on the condition of the medium in order to obtain pH close to neutral.

The first deoxidation step was carried out in 20 minutes, starting from the ending of the acid step at 80° C., at 11% consistency, with a charge of chlorine dioxide corresponding to 8 kilogram of active chlorine/ton cellulose. The "D1" step was carried out using a charge of chlorine dioxide corresponding to 27 kilogram of active chlorine/ton cellulose, pH 3.5 to 4.5, at a temperature of 80° C., for 3 hours, at 11% consistency. The "EP" step was carried out using hydrogen peroxide of 1 kilogram per ton cellulose, pH of 11.3 to 11.7, temperature of 70° C. for 1 hour, at 11% consistency. The "D2" step was carried out using a charge of chlorine dioxide corresponding to 1 kilogram of active chlorine/ton cellulose, pH 5 to 6, at a temperature of 75° C., for 3 hours, at 11% consistency.

Enzymes application during the bleaching sequence also presented high level of fibers features distinction. As examples, the use of cellulase in place of the alkaline extraction after the chlorine dioxide step raised the tensile in 62%, with a relatively small change in drainage (decrease of only 8%). The summary presented on Table 4 exemplifies the extremes in the distinction noted for applications of enzymes in the bleaching sequence using an acid step before this one.

TABLE 4

Summary of the extremes results observed in the enzymatic treatment associated with an acid step, when applied in the middle of the bleaching sequence.

| Fibers features | Increase of up to | Decrease of up to |
|---|---|---|
| Flexibility | 7% | 5% |
| Carboxylic groups number | Not occurred | 22% |
| Tensile index | 62% | 8% |
| Pulp Flow Resistance | 8% | 4% |

Example 4

Enzymatic Treatment Applied After Bleaching Having an Acid Step

The following shows examples of enzymatic treatment after bleaching followed by the acid step.

Example 4.1

Xylanase, Cellulase and Mixture Thereof Application After Bleaching Having an Acid Step Bleaching sequences of the type Do EOP D1 EP D2, A Do PO D1 D2 e A Do PO D P had application of xylanase, cellulase and mixtures thereof after the last step of bleaching and before drying. The acid step was carried out at 90° C., pH from 3 to 4.5, for 3 hours, at 11% consistency. The first step of deoxidation was carried out in 20 minutes, at 80° C., at 11% consistency with a charge of chlorine dioxide corresponding to 8 kilograms of active chlorine/ton cellulose. The "EOP" step was carried out using pH from 11.3 to 11.7, temperature of 75° C., for 1 hour, 5 kilogram of oxygen/ton cellulose and pressure of 45 psi, with addition of 1.5 kilogram of hydrogen peroxide/ton cellulose. The "D1" step was carried out using a charge of chlorine dioxide that corresponds to 15 kilograms of active chlorine/ton cellulose, pH from 3.5 to 4.5, temperature of 80° C., for 3 hours, at 11% consistency. The "EP" step was carried out using a charge of hydrogen peroxide of 1 kilogram per ton cellulose, pH from 11.3 to 11.7, temperature of 70° C., for 1 hour at 11% consistency. The "D2" step was carried out using a charge of chlorine dioxide that corresponds to 1 kilogram of active chlorine/ton cellulose, pH 5 to 6, temperature of 75° C., for 3 hours at 11% consistency. b) In the sequence of the type Do PO D1 D2 or ending with P. The acid step was carried out at 90° C., pH from 3 to 4.5, for 2 hours, at 11% consistency. The first step of deoxidation was carried out in 15 minutes, 90° C., at 11% consistency using a charge of chlorine dioxide corresponding to 22 kilograms active chlorine/ton cellulose. The "PO" step was carried out using pH from 11.3 to 11.7, at a temperature of 80° C., for 90 minutes, 5 kilograms of oxygen/ton cellulose and 5 kilograms of nitrogen/ton cellulose and pressure of 72 psi with 3 kilograms of hydrogen peroxide/ton cellulose added. The "D1" step was carried out using a chlorine dioxide charge of 5 kilograms of active chlorine/ton cellulose, pH 3.5 to 4.5, at a temperature of 80° C., for 90 minutes, at 11% consistency. The "D2" step was carried out using a chlorine dioxide charge of 2 kilograms of active chlorine/ton cellulose, pH 4 to 5, at a temperature of 80° C., for 90 minutes, at 11% consistency. The "P" step was carried out using a hydrogen peroxide charge of 2 kilograms of hydrogen peroxide/ton of cellulose, pH from 10.0 to 10.5, at a temperature of 80° C., for 90 minutes, at 11% consistency. Commercially available xylanase and cellulase enzymes were used. 0.5 kilogram of xylanase/ton of cellulose and 1 kilogram of cellulase/ton cellulose, pH of about 7, temperature of 55° C., in a 3 hours treatment, with the suspension at 11% consistency. After the enzymatic treatment, a enzyme denaturation treatment was performed consisting in washing the enzyme-treated cellulose, dewatering for up to a consistency of 25 to 30% by weight, heating the medium at temperature of 85 to 95° C., for 10 to 15 minutes.

Increases of up to 24% in tensile, with no significant loss in drainage were observed with cellulase application. Increases in drainage of up to 7% with no loss in tensile were also measured with xylanase application.

Summary of the treatments applied after bleaching with acid step.

The extremes in the distinction of the features of fibers are shown in table 5.

TABLE 5

Summary of the extremes results observed in the enzymatic treatment when applied in the end of the bleaching step with an acid step.

| Fibers features | Increase of up to | Decrease of up to |
|---|---|---|
| Flexibility | 3% | Not occurred |
| Carboxylic groups number | Not occurred | 22% |
| Tensile index | 24% | Not occurred |
| Pulp Flow Resistance | 3% | 7% |

Example 5

Enzymatic Treatments Applied in More than One Stage, Before, During and/or after Bleaching Having an Acid Step The following shows examples of enzymatic treatment applied into different process bleaching stages having an acid step.

Example 5.1

Enzymes Application in More than One Process Stage Using Bleaching Having an Acid Step The following experimental conditions were used:

a) Enzymes application before bleaching: use of xylanase charge of 0.5 kilogram xylanase/ton cellulose, pH of about 7, temperature of 75° C., in a 3 hours treatment, at 11% consistency of the suspension. The use of cellulase charge of 1 kilogram cellulase/ton cellulose, pH of about 7, temperature of 50° C. in a 3 hours treatment, at 11% consistency.

b) Enzymes application during the bleaching sequence: use of xylanase charge of 0.5 kilogram xylanase/ton cellulose, pH of about 7, temperature of 75° C., in a 1 hour treatment, at 11% consistency. Use of cellulase charge of 1 kilogram cellulase/ton cellulose, pH of about 7, temperature of 50° C. in a 1 hour treatment, at 11% consistency.

All cases were carried out using an acid step at 90° C., pH from 3 to 4 for 3 hours, at 11% consistency. After the enzymatic treatment, a enzyme denaturation treatment was performed consisting in washing the enzyme-treated cellulose, dewatering for up to a consistency of 25 to 30% by weight, heating the medium at temperature of 85 to 95° C., for 10 to 15 minutes.

Enzymes application in more than one step of the process presents high fibers distinction, especially when used in the beginning of and during the bleaching step. Improvement of up to 9% in drainage was observed with the application of more than one step using xylanase. Increases of up to 58% in tensile were measured by applying one xylanase stage before bleaching and one step with mixtures of cellulase and xylanase during bleaching.

All cases studied showed a tendency for fibers features distinction maintenance after bleaching (before drying) with the application of enzymes in the beginning and/or during the bleaching step.

The extremes of interest fibers features distinction are shown in Table 6.

Summary of the treatments applied in more than one process step, for bleaching with an acid step.

TABLE 6 summary of the extremes results observed in the enzymatic treatment applied in more than one step process.

| Fibers features | Increase of up to | Decrease of up to |
|---|---|---|
| Flexibility | 2% | 3% |
| Carboxylic groups number | Not occurred | 27% |
| Tensile index | 58% | 27% |
| Pulp Flow Resistance | 7% | 9% |

The invention claimed is:

1. A process for producing cellulose fibers having improved flexibility and strength features comprising: at least one enzymatic treatment followed by at least one acid step performed one after another with or without washing of the cellulose fibers between the same, but without any other steps in between said at least one enzymatic treatment and said at least one acid step, wherein the retention time during the enzymatic treatment ranges from 40 to 240 minutes the enzymatic treatment is performed in a medium having a pH ranging from 5.5 to 8.5 , having a temperature ranging from 40 to 90° C., and having a hydrolytic enzyme charge ranging from 0.10 to 2.0 kilogram of enzyme/ton cellulose;

wherein the retention time of the acid step ranges from 20 to 200 minutes, the acid step is performed in a medium having a temperature ranging from 80 to 95° C. and having a pH ranging from 3 to 4.5;

wherein in the enzymatic treatment a hydrolytic enzyme selected from the group consisting of cellulases, xylanases and mixtures thereof is used; and wherein the process further includes a step of bleaching the fibers following said at least one enzymatic treatment and said at least one acid step.

2. The process according to claim 1, characterized in that the medium temperature during the enzymatic treatment ranges from 50 to 90° when the hydrolytic enzyme is xylanase.

3. The process according to claim 1, characterized in that the medium temperature during the enzymatic treatment ranges from 40 to 80° when the hydrolytic enzyme is cellulase.

4. The process according to claim 1, wherein said fibers are eucalyptus fibers.

5. The process according to claim 1, wherein the process includes a further enzymatic treatment step following a bleaching with acid step, and wherein resulting cellulose fibers exhibit an increase in tensile index of up to 24%.

* * * * *